US006042113A

United States Patent [19]

Walker

[11] Patent Number: 6,042,113

[45] Date of Patent: Mar. 28, 2000

[54] HANDHELD MATCHBOOK-SIMULATING GAMES AND GIFTS

[76] Inventor: Judy M. Walker, 3650 Chambers St., Eugene, Oreg. 97405

[21] Appl. No.: 09/078,319

[22] Filed: May 13, 1998

Related U.S. Application Data

[60] Provisional application No. 60/046,717, May 16, 1997.

[51] Int. Cl.[7] ..... A63F 9/00

[52] U.S. Cl. ..... 273/138.1; 273/141 R; 206/99; 206/103; 206/116; 206/457; 206/459.5; D9/304

[58] Field of Search ..... 206/99, 103, 104, 206/114, 116, 457, 459.5; D9/304; 273/141 R, 138.1

[56] References Cited

U.S. PATENT DOCUMENTS

| | | | |
|---|---|---|---|
| D. 136,101 | 8/1943 | Salfisberg | D9/304 |
| D. 237,947 | 12/1975 | Ochial | D9/304 |
| D. 288,172 | 2/1987 | Kanellos | D9/304 |
| 1,728,509 | 9/1929 | Rahe | 206/103 |
| 2,003,870 | 6/1935 | St. John | D9/304 X |
| 2,105,842 | 1/1938 | Pindell | 206/103 |
| 2,184,629 | 12/1939 | Weiss | 206/103 |
| 2,254,545 | 9/1941 | Roberts | 206/103 |
| 2,547,779 | 4/1951 | Renyck | 206/104 |
| 5,119,941 | 6/1992 | Lepie | 206/104 |

FOREIGN PATENT DOCUMENTS

| | | | |
|---|---|---|---|
| 549143 | 7/1956 | France | 206/103 |
| 15439 | of 1895 | United Kingdom | 206/104 |

*Primary Examiner*—Benjamin H. Layno
*Attorney, Agent, or Firm*—Christie, Parker & Hale, LLP

[57] ABSTRACT

A game or gift shaped as a simulated matchbook cover containing one or more tear-out strips anchored to the lower end of the cover in essentially the same fashion as matches in a conventional pocket matchbook. The strips are elongated panels which can be torn from the cover, and which bear messages on one or both sides. Alternatively, the strips are tear-out envelopes in which messages or small gifts are inserted. In one form, a spinner is rotatably secured to the cover, and the resting position of the spinner designates one or more specific strips to be torn from the cover.

4 Claims, 3 Drawing Sheets

FIG. 1
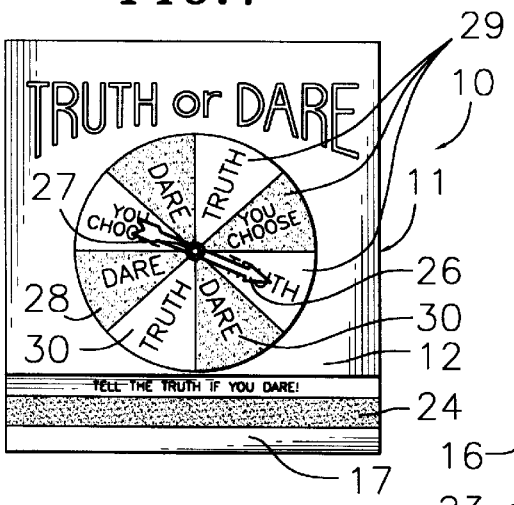
FIG. 4
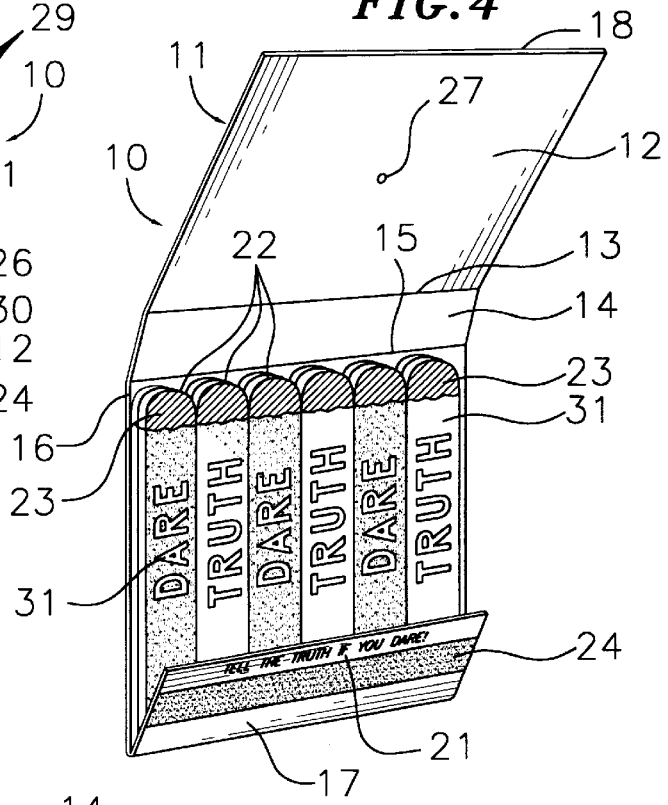
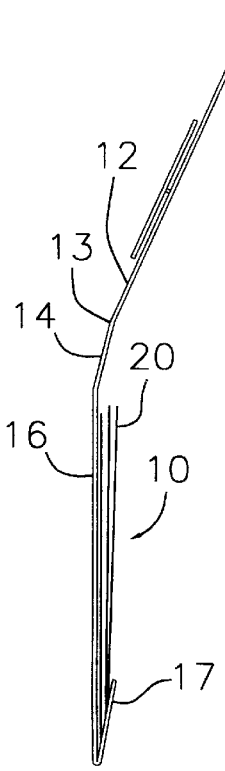
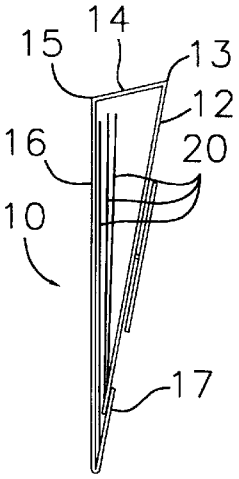
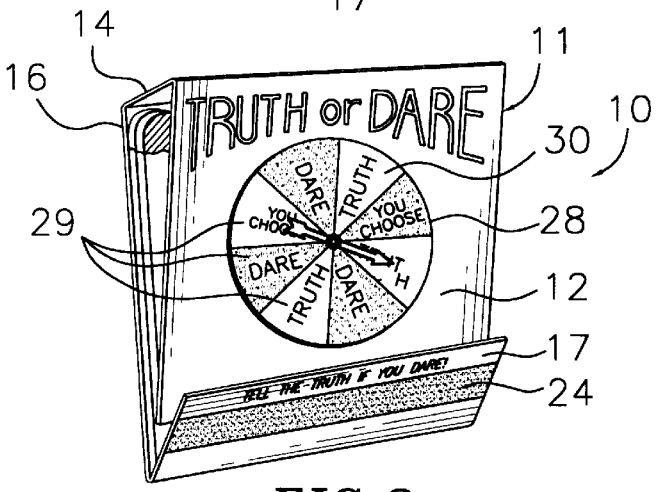
FIG. 3
FIG. 5 FIG. 2

FIG. 6
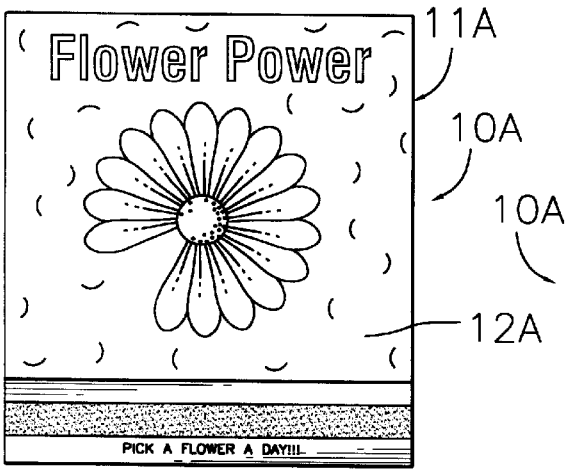
FIG. 7
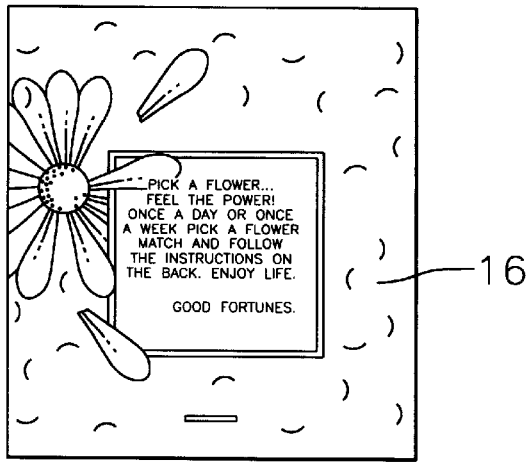
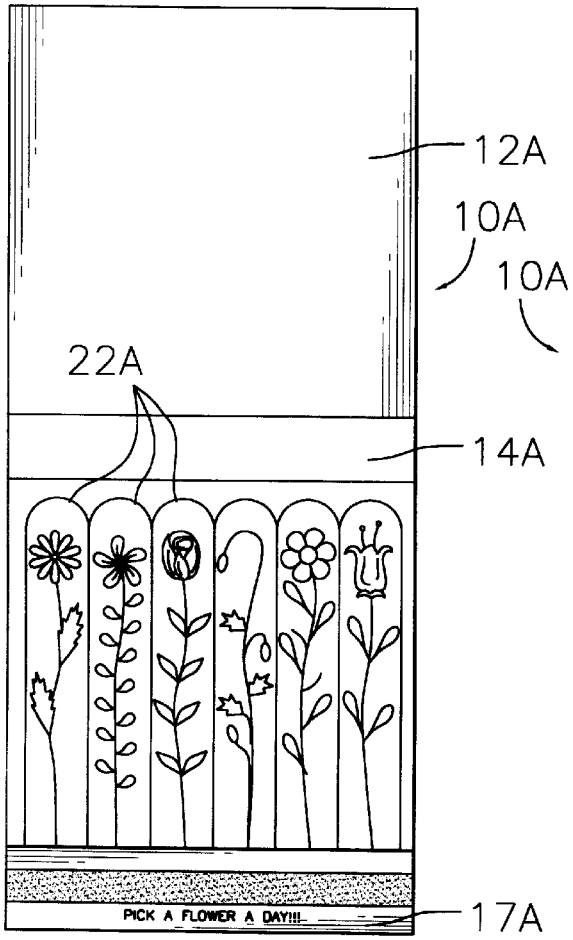
FIG. 9
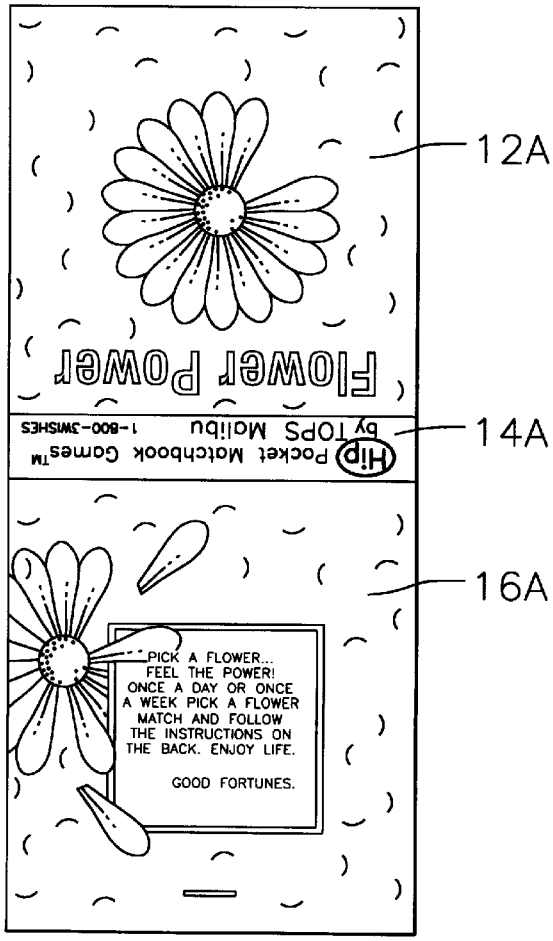
FIG. 8

HANDHELD MATCHBOOK-SIMULATING GAMES AND GIFTS

CROSS REFERENCE TO RELATED APPLICATION

This application claims the benefit of U.S. Provisional Application No. 60/046,717 filed May 16, 1997.

BACKGROUND OF THE INVENTION

This invention relates to handheld or pocket games and gifts which are packaged as simulated matchbooks. Each simulated matchbook has a folded cover, and rows of match-simulating strips or tabs within the cover. In one form, the strips are printed on one or both sides with various messages in the nature of questions, answers, or other game statements. Though in some embodiments having many aspects of the appearance of a conventional matchbook, the usual striking surface is simulated and inoperative, and the match-simulating strips lack inflammable tips. In one form, a pivoted spinner arrow is mounted on the cover to add a game-of-chance feature. In another form, the tear-out strips are elongated envelopes containing small gifts.

SUMMARY OF THE INVENTION

The simulated matchbook of this invention includes a folded cover having front and rear panels joined at upper ends, and a folded lower end of the rear panel forming a lip within which a lower end of the front panel can be selectively seated to close the cover. At least one tear-out strip, which may be a flat elongated panel or envelope, is secured by a fastener within the cover between the lip and rear panel. The strip bears a printed message on one or both sides, or is alternatively an envelope for containing a message or small gift. In one form a plurality of such strips are provided within the cover, and in another embodiment a rotatable spinner is mounted on the front panel to select one or more specific strips to be torn from the cover.

BRIEF DESCRIPTION OF THE DRAWINGS

FIG. 1 is a front elevation of a game according to the invention;

FIG. 2 is a side elevation of the game;

FIG. 3 is a perspective view of the game;

FIG. 4 is a view similar to FIG. 3, but with the game cover in an open position;

FIG. 5 is a side elevation of the game as shown in FIG. 4;

FIG. 6 is a front elevation of an alternative embodiment of the game;

FIG. 7 is a rear elevation of the game shown in FIG. 6;

FIG. 8 is an elevation of the outer surfaces of an opened cover of the game shown in FIG. 6;

FIG. 9 is an elevation of the inner surfaces of an opened cover of the game shown in FIG. 6;

DESCRIPTION OF THE PREFERRED EMBODIMENTS

Figure 10:
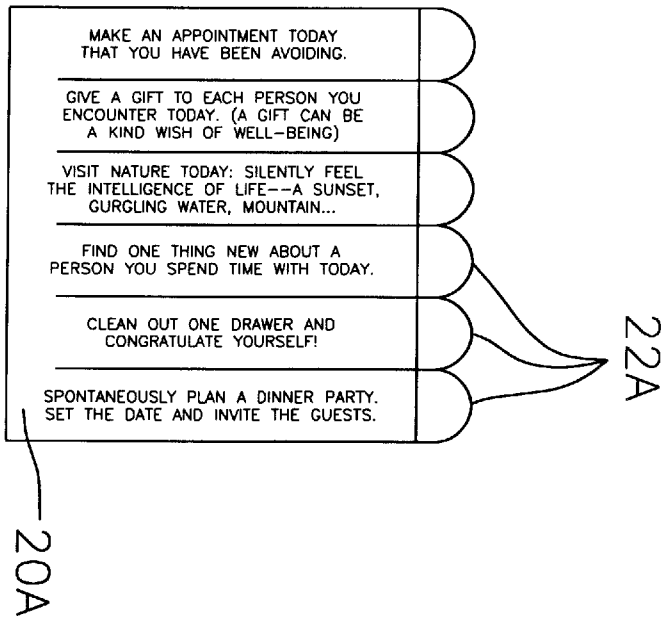
FIG. 10 is a rear view of simulated matches of the game as depicted in FIG. 9.

A first embodiment of a game 10 according to the invention is shown in FIGS. 1–5. The game includes a matchbook-simulating folded cover 11 made of paper card stock, and having a front panel 12 joined at a fold line 13 to a narrow rectangular top panel 14 which is in turn joined at a fold line 15 to a rear panel 16. The bottom of the rear panel is folded forwardly and upwardly to form a rectangular lip 17 beneath which a free end 18 of front panel 12 can be inserted to close the cover as shown in FIGS. 1–3.

Rows of simulated-match panels 20 are fitted between rear panel 16 and lip 17, and are secured in place by a staple 21 or other fastening means as is conventional in regular matchbooks. Individual adjacent simulated-match strips 22 are severed from each other along adjoining side edges so individual strips can be torn and separated from the cover. Optionally, the simulation of a regular matchbook can be enhanced by printing contrasting colors on tips 23 of the individual strips, and on a band 24 along the front surface of lip 17.

An arrow-shaped spinner 26 is centrally positioned on front panel 12, and is rotatably mounted on a pivot 27 secured to the front panel. As shown in FIGS. 1 and 4, a circular pattern 28 is printed on the front panel concentric with pivot 27, and the pattern is divided into segments 29 containing printed words, colors or messages 30. These words, messages or symbols need not necessarily be arranged in a segmented-circle pattern, and other displays may be used. In the illustrated embodiment, corresponding messages 31 are printed on the front surfaces of strips 22, and further messages or instructions (not shown) are printed on rear surfaces of the strips.

In use, each player spins spinner 26, and notes the message in the segment or zone in which the spinner arrowhead comes to rest. The cover is then opened, and a strip having the same message is torn from the cover to reveal a further message on the strip rear surface. Typical such further messages for strips marked "DARE" are "Whistle a show tune," "Perform your best athletic trick or stunt," and "Kiss the person across from you." Typical such further messages for strips marked "TRUTH" are "What really happened on prom night?" and "What did you really want for Christmas, but not get?" The players alternate in acting out the instructions, and the best performer wins the game.

A second alternative embodiment of a game 10A is shown in FIGS. 6–10, and is similar in construction to game 10, with the exception that no spinner is used on front panel 12A. As shown in FIGS. 6–8, the outer surfaces of cover 11A are printed with instructions, messages, and attractive designs, and the front surfaces of individual severable strips 22A are printed with designs, or alternatively with words or messages. The player tears an arbitrarily selected strip from the cover to reveal further messages or inspirational suggestions on the strip rear surface as shown in FIG. 10.

The object of the game of this invention is to amuse and entertain each player, and in some embodiments, to provide the basis for an interparty competitive game. The invention is not limited to the specifically described embodiments, and extends to tear-out gift-containing strips or envelopes and the like. Similarly, the materials or elements within the cover may be pads of small note or message papers bearing word or symbolic messages.

Figure 11:
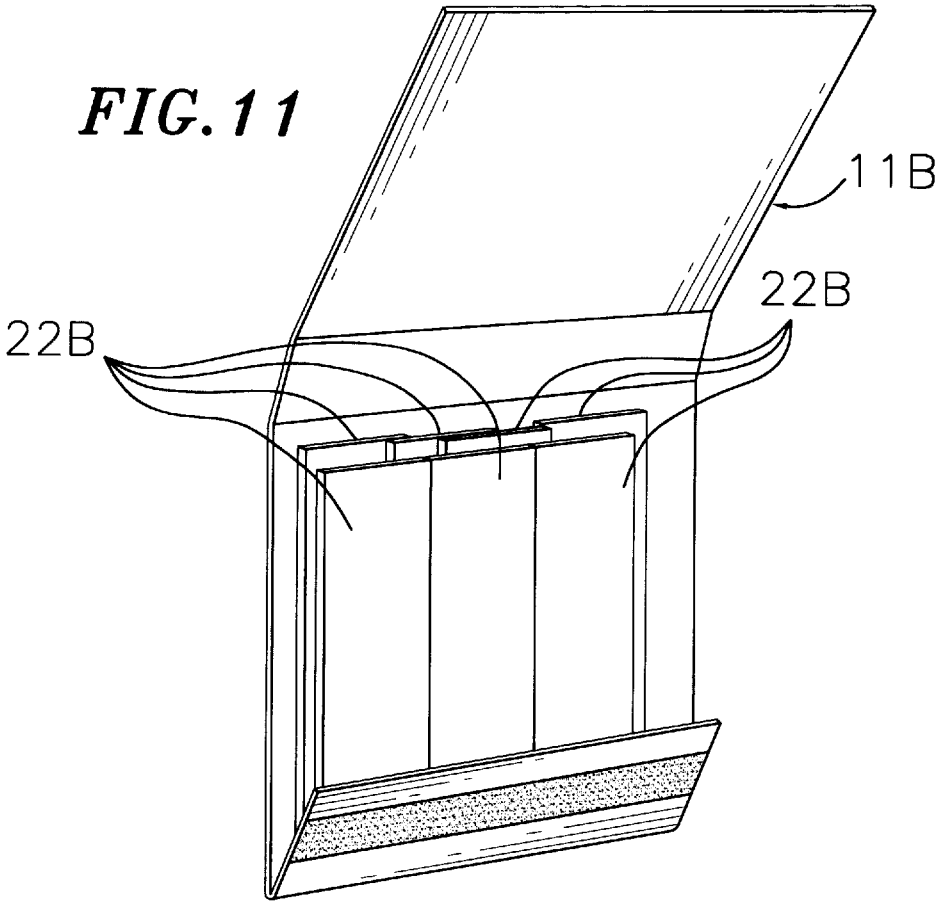
FIG. 11 is a perspective view similar to FIG. 4, but of a second alternative embodiment in which tear-out gift-containing envelopes are provided within the cover.

For example, FIG. 11 shows a cover 11B housing a plurality of envelope-like strips 22B secured at their lower ends to the cover as described above, and each containing an amusing or inspirational message, or a small gift item. In the form depicted in FIG. 11, seven such envelope strips are provided to contain a message or gift for each day of the user's birthday week. If desired, a transparent sheet (not shown) of plastic film can extend upwardly over the front faces of the strips, and downwardly over the rear faces of the strips, the ends of the sheet being secured in the lip. The sides of the sheet are open to provide access to tear out the individual strips. Alternatively, only a single larger envelope strip can be provided within the cover to contain messages or gifts.

The games are compactly packaged, and can be economically produced and printed from readily available materials. A common theme of most of the disclosed embodiments is the selection of an individual strip or other interior element either arbitrarily or by using a spinner, and then removing or referring to the strip or element to reveal further printed information or related material on the front or rear surface of or within the strip.

What is claimed is:

1. A simulated matchbook comprising:

a folded flexible cover having a front panel and a rear panel, the front and rear panels having upper ends which are integrally joined, the rear panel having a lower end which is folded forwardly and upwardly to form a lip beneath which a free lower end of the front panel can be inserted to close the cover;

a plurality of tear-out strips, each strip having a lower end inserted within the cover lip, and extending upwardly within the cover, each strip being elongated and bearing a printed message;

fastening means securing the strips within the cover lip, and enabling the strips to be torn therefrom; and a spinner rotatably mounted on the front cover, and indicia on the front cover guiding a user to a specific strip or strips for each rotatable position of the spinner.

2. The simulated matchbook defined in claim 1 in which at least some of the strips are envelopes for containing a message or gift.

3. A simulated matchbook comprising:

a folded flexible cover having a front panel and a rear panel, the front and rear panels having upper ends which are integrally joined, the rear panel having a lower end which is folded forwardly and upwardly to form a lip beneath which a free lower end of the front panel can be inserted to close the cover;

a plurality of strips, each strip having a lower end inserted within the cover lip, and extending upwardly within the cover, each strip being elongated and bearing a printed message; and fastening means securing the strips within the cover lip, and enabling the strips to be torn therefrom;

each of said tear-out strips having front and back sides, there being printed indicia on both sides.

4. The simulated matchbook defined in claim 3 in which at least some of the strips are envelopes for containing a message or gift.

* * * * *